United States Patent [19]

Hsieh

[11] Patent Number: 4,896,003

[45] Date of Patent: Jan. 23, 1990

[54] MULTI-POSITION ELECTRICAL SWITCH

[76] Inventor: Man-Ching Hsieh, 5th Floor #34, Alley 73, Tung Yuan Street, Shuang Yuan District, Taipei, Taiwan

[21] Appl. No.: 374,054

[22] Filed: Jun. 30, 1989

[51] Int. Cl.[4] ..... H01H 25/00; H01H 13/70

[52] U.S. Cl. ..... 200/6 A; 200/5 A; 200/517; 200/557; 200/339

[58] Field of Search ..... 200/5 R, 5 A, 6 A, 511, 200/512, 517, 557, 292, 339, DIG. 29

[56] References Cited

U.S. PATENT DOCUMENTS

| | | | |
|---|---|---|---|
| 2,808,476 | 10/1957 | Elliott | 200/6 |
| 3,005,055 | 10/1961 | Mattke | 179/90 |
| 3,988,556 | 10/1976 | Hyodo | 200/511 |
| 4,019,247 | 4/1977 | Borel et al. | 29/578 |
| 4,124,787 | 11/1978 | Aamoth et al. | 200/6 A |
| 4,132,873 | 1/1979 | Vanderpoel | 200/6 R |
| 4,246,452 | 1/1981 | Chandler | 200/6 A X |
| 4,256,931 | 3/1981 | Palisek | 200/6 A X |
| 4,297,542 | 10/1981 | Shumway | 200/6 A |
| 4,349,708 | 9/1982 | Asher | 200/6 A |
| 4,394,548 | 7/1983 | Dola | 200/6 A |
| 4,408,103 | 10/1983 | Smith, III | 200/6 A |
| 4,428,649 | 1/1984 | Main et al. | 200/6 A X |
| 4,439,648 | 3/1984 | Reiner et al. | 200/6 A |
| 4,476,356 | 10/1984 | Nakayama | 200/6 A |
| 4,484,042 | 11/1984 | Matsui | 200/67 |
| 4,486,629 | 12/1984 | Sledesky | 200/6 A |
| 4,511,769 | 4/1985 | Sahakian et al. | 200/6 A |
| 4,614,847 | 9/1986 | Sasao | 200/6 A |
| 4,687,200 | 8/1987 | Shirai | 200/339 X |

*Primary Examiner*—J. R. Scott

*Attorney, Agent, or Firm*—LaValle D. Ptak

[57] ABSTRACT

A multi-directional switch which is utilized for completing selected ones of a number of different electrical circuits is placed in a housing in which the different electrical circuits to be controlled terminate in pairs of spaced-apart conductors located in the bottom of the housing. A cylindrical pushbutton actuating member extends upwardly through a circular opening in the top of the housing. This actuating member has a flange on the lower end which extends radially outwardly from the main body of the actuating member, and this flange is supported on a deformable support which has a circular opening in the center. A ball bearing is placed in the opening the deformable support and engages the bottom of the housing and the bottom of the actuating member. Conductive contacts are placed on the lower side of the deformable support in registry with the various contact pairs; so that when the actuating member is tilted over a selected contact pair, the corresponding conductive contact completes an electrical circuit across the contact pair selected by the direction of tilting the actuating member.

25 Claims, 1 Drawing Sheet

MULTI-POSITION ELECTRICAL SWITCH

BACKGROUND

Multiple position switches are used in many applications. For example, multiple position switches, commonly referred to as joy stick switches, are widely used for electronic games and the like. Such switches also are found in the steering control devices for self propelled electric wheel chairs. Computers frequently employ multiple position or multi-direction switches for controlling the movement of a cursor on a computer display screen.

Five patents which are specifically directed to multi-position or multi-directional switch mechanisms are the U.S. Pat. Nos. to Chandler 4,246,452; Smith 4,408,103; Main 4,428,649; Nakayama 4,476,356; and Shirai 4,687,200. All of these patents disclose the use of a central actuating lever of key which is pivoted or tipped about a central point to close switch contacts located in a circle around this central point. The operation of the mechanisms disclosed in all of these patents is substantially the same. A resilient member of spring is used to return each of the actuating levers of the switches of these patents to a rest or neutral position. Separate metal springs are used for this purpose, with the exception of the Shirai and Smith Patents which disclose the use of a resilient circular elastomeric member to provide the return spring function. In all of these patents, the pivot portion comprises either an extension which is formed as an integral part of the switch actuating lever, or is formed as an integral part of the base or bottom of the housing in which the switch is located. It has been found that the plastic projections forming the pivots in the devices disclosed in these patents typically have a substantial amount of friction which reduces the quickness of the response of the switch. In addition, when the switch undergoes extensive use, significant wear frequently is encountered in the pivot of such integrally molded parts.

It is desirable to provide a multi-position electrical switch which incorporates the advantages of the prior art devices and which reduces friction and wear.

SUMMARY OF THE INVENTION

Accordingly, it is an object of this invention to provide an improved multi-position electrical switch.

It is another object of this invention to provide a compact, simple and efficient multi-directional switch.

It is an additional object of this invention to provide an improved multi-directional switch which requires minimum force to operate.

It is a further object of this invention to provide an improved multi-position or multi-directional electrical switch which exhibits reduced friction and reduced wear over periods of extensive use.

In accordance with a preferred embodiment of this invention, a multi-position electrical switch is mounted in a housing having a bottom and a top. Pairs of spaced-apart conductors are located on the bottom of the housing, and each of the pairs of conductors are located a predetermined distance from a point on the bottom of the housing. A cylindrical actuating member extends upwardly through an opening in the top of the housing. This actuating member has a flange on the lower end, and the flange extends radially outwardly from the central axis through the member. The opening in the top of the housing is aligned with the point on the bottom; and a deformable, resilient support member, which has a circular opening in its center, is located between the flange and the bottom of the housing. A spherical bearing is located in the opening in the support member, and this bearing engages the point on the bottom of the housing and a corresponding point at the center of the bottom of the flange of the actuating member. Conductive contacts are located on the bottom of the deformable support member, and each contact is positioned to bridge corresponding ones of the pairs of the spaced-apart conductors. When the actuating member is tilted downwardly about the spherical bearing toward a selected one of the pairs of conductors, the corresponding contact engages the pair of conductors to complete an electric circuit. When the actuating member is released, the resilient support member returns the actuating member to a neutral or rest position where none of the conductive contacts are in electrical contact with any of the pairs of conductors.

DETAILED DESCRIPTION

Figure 1:
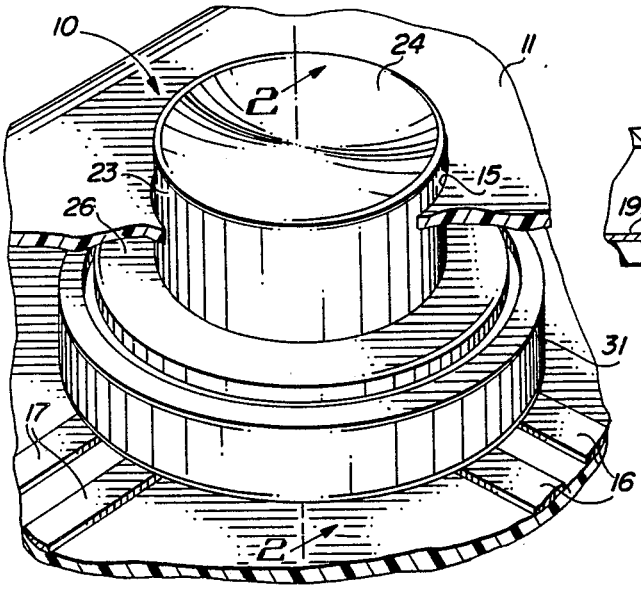
FIG. 1 is a partially cut-away top perspective view of a preferred embodiment of the invention.

Reference now should be made to the drawings in which the same reference numbers are used through the different figures to designate the same components. FIG. 1 is a perspective view of a preferred embodiment of a multi-position electrical switch which may be used for a variety of different applications. Such switches typically are housed in relatively compact plastic housings. Since the configuration of the housing may vary considerably, depending upon the device with which the switch is used, only a portion of such a housing 10, in the form of a small part of a top 11 and a bottom 12 is illustrated in FIG. 1. Obviously, sides and ends (not shown) are employed to enclose the housing and to space the top 11 and the bottom 12 from one another. At the location where the multi-position switch is to be located, a circular opening 15 is formed in the top 11. This opening is shown most clearly in FIGS. 1, 2 and 3.

The actuator for the switch mechanism comprises a cylindrical plastic pushbutton 23 with a concave top 24. The outer diameter of the pushbutton or actuator 23 is less than the diameter of the opening 15 to permit the actuator 23 to extend upwardly through the opening 15. The difference in diameters also is selected to provide clearance to permit the actuator 23 to be rocked or tilted in any direction in the opening 15, as indicated generally by the arrows in FIG. 2. The bottom of the actuator 23 has an integrally formed, circular flange 26 attached to it. The diameter of the flange 26 is greater than the diameter of the opening 15 in the top 11 to captivate the actuator 23 in the housing 10 when the unit is assembled together.

Figure 4:
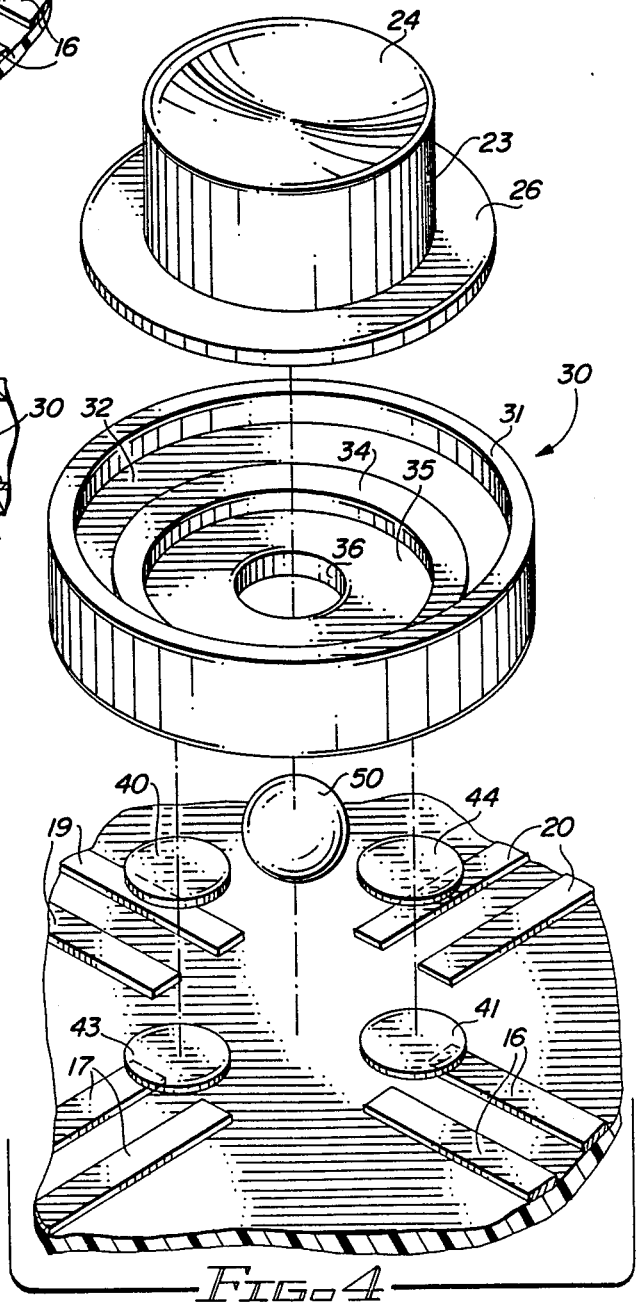
FIG. 4 is an exploded view of the preferred embodiment of the invention shown in FIG. 1.
Figure 5:
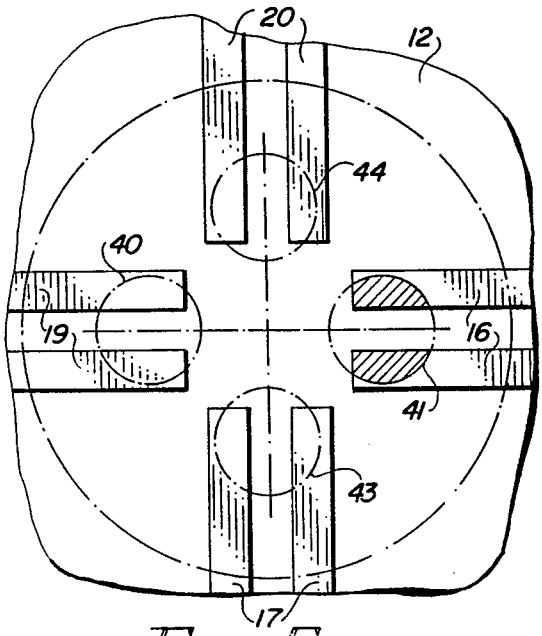
FIG. 5 is a top view of a portion of the embodiment shown in FIGS. 1 though 4.

As illustrated most clearly in FIG. 5, the base 12 has four (4) pairs of conductive metal strips 16, 17, 19, and 20, located on it at 90° intervals about a central point which is aligned with the central axis of the actuator 23. These pairs of conductive strips 16, 17, 19, and 20, preferably are in the form of integrated circuit conductors which are interconnected with other circuit elements (not shown) for effecting the desired function to be accomplished by completing or closing an electrical circuit between the two conductors of each pair. It is apparent from an examination of FIGS. 4 and 5, that without some type of contact bridging the ends of the pairs of conductors 16, 17, 19, and 20, they represent an open circuit or open switch.

A deformable resilient support member 30 is placed between the bottom of the flange 26 and the top surface of the housing bottom 12 to support the actuator 23 and to cause it to extend through the circular opening 15 in the top 11 of the housing. This resilient support member preferably is made of rubber or other suitable elastomeric material, and is sufficiently rigid to support the actuator 23 in a rest or neutral position, as illustrated most clearly in FIG. 2.

The member 30 has an outer circular flange 31 on it which supports an intermediate web 32 comprising a circular disk integrally formed with the flange 31. Spaced from the inner edge of the flange 31 is an upwardly extending circular rim 34, the top of which engages the underside of the flange 26 on the actuator member 23. The center of the support member 30 has a circular opening 36 in it (shown most clearly in FIG. 4), and a spherical ball or ball bearing 50 is located in this opening 36. Preferably the ball 50 is made of stainless steel or other suitable material. As most clearly shown in FIGS. 2 and 3, the ball bearing 50 engages a mating concave depression 51 in the bottom of the actuator 23 and rests on the central point on the bottom of the housing located in the center of the ends of the contact pairs 16, 17, 19, and 20.

Located directly above each of the ends of the contact pairs 16, 17, 19, and 20 are mating circular conductive rubber contact disks 40, which are attached to the underside of the web portion 32 of the deformable resilient support member 30. The location of these disks is most clearly shown in FIGS. 4 and 5, although two of them, conductive disks 40 and 41, also are shown above the respective contact pairs 19 and 16 in FIGS. 2 and 3. Additional disks 43 and 44 are located in alignment with the contact pairs 17 and 20, respectively, as shown in FIGS. 4 and 5. The disks 40, 41, 43, and 44 are bonded to or are secured to the underside of the web portion 32 of the deformable support member in any suitable manner. The remainder of the parts forming the pushbutton switch are not permanently interconnected, but are held in place by the configuration of the housing 10, so that assembly and disassembly simply is effected by stacking and unstacking the parts in accordance with the illustration show in FIG. 4.

Figure 2:
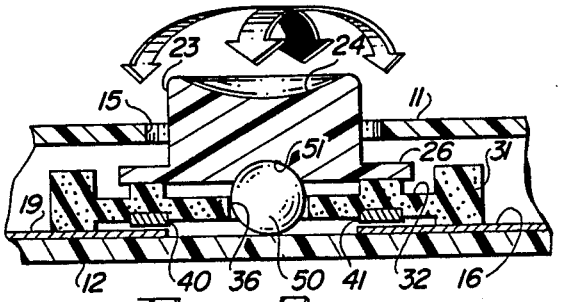
FIG. 2 is a cross-sectional view taken along the line 2—2 of FIG. 1.

In operation, the switch is held at a rest or neutral, unoperated position by the resilient support member 30 which returns to its "memory" position, as shown in FIG. 2, to space all of the conductive rubber contact disks 40, 41, 43 and 44 above and out of contact with the respective pairs of conductors 16, 17, 19, and 20. This is illustrated in FIG. 2. To operate the switch, a person simply places a finger in the concave depression 24 on the top of the actuator 23 and pushes the actuator in the desired direction to close the desired circuit between the corresponding pairs of conductors to perform an associated circuit operation. Because the ball bearing 50 is rigid and essentially friction free, the force required to tip the actuator 23 is dependent only upon the resiliency of the deformable support member 30.

Figure 3:
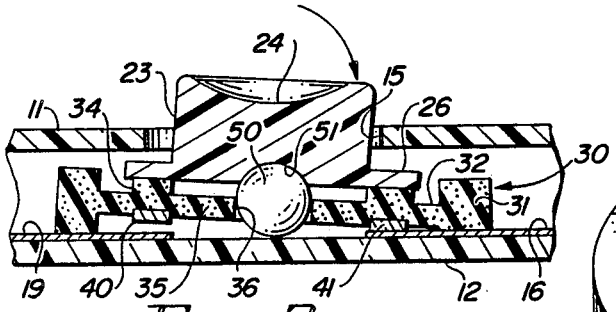
FIG. 3 is a cross-sectional view taken along the same line as FIG. 2, but illustrating a different position of operation of the device.

When the device is operated to tip the actuator 23 toward the right, as viewed in FIGS. 2 and 3, the resilient support member 30 is deformed to the position shown in FIG. 3. This causes the conductive rubber contact disk 41 to press against the upper surface of the two conductors forming the conductor pair 16 to make an electrical connection from one conductor of the pair to the other through the contact disk 41. The manner in which this is done is illustrated in FIGS. 3 and 5. In FIG. 5, the shading on the ends of the conductor pair 16 made by the contact disk 41 is indicative of electrical contact being made between the two conductors of the pair 16. None of the other conductive disks 40, 43 or 44 make connection in this position, since the resilient support member 30 continues to hold these disks out of engagement with the conductors with which they are associated. Tipping or tilting of the actuator 23 in any of the other directions indicated in FIG. 2 closes a corresponding circuit between the ends of the associated conductors located in the direction in which the actuator 23 is tilted. Although four sets of conductor pairs located at 90° spacings in a circle about the central pivot point of the ball bearing 50 are illustrated, more or less conductor pairs may be used in accordance with the particular application which is intended for the multi-position switch mechanism. Four (4) directions, however, are relatively common and constitute a popular configuration for such a switch.

The stainless steel ball bearing 50 significantly reduces friction over plastic projections or fulcrums of the type which have been used previously. Since the friction is reduced, wear and potential mechanical failure also is reduced. The ball bearing 50 evenly distributes pressures applied to the top 24 of the actuator 23 during operation. Since friction is reduced by the ball bearing or spherical ball support 50, a livelier operating action requiring less force is achieved. Consequently, the switch may be activiated with less force or finger pressure to make it particularly suitable for hand held devices. In addition, the device is potentially easier to use by persons with restricted hand movement and strength. This latter advantage is particularly important, for example, when the device is used for a control system for a self-propelled wheel chair or for a bedside signaling device for hospital patients.

Various changes and modifications will occur to those skilled in the art without departing from the true scope of the claims. For example, the actuator 23, with its associated flange 26 is described as being plastic, but it could be made of metal as well, if desired. Other materials may be found suitable. In addition, the particular configuration of the deformable resilient support member is to be considered illustrative only since the function of this member may be attained with other cross-sectional shapes, for example. The contact disks have been described as being made of conductive rubber, but metal disks could be used as well without in any way departing from the true scope of the invention. Other changes and modifications also will occur to those skilled in the art without departing from the true scope of the invention, as defined in the appended claims.

I claim:

1. A multi-position electrical switch including in combination:

a housing having a bottom and a top, said top having an opening therethrough;

at least two pairs of spaced-apart conductors located adjacent the bottom of said housing, each pair of conductors located at a predetermine distance from a point on said bottom;

an actuating member extending through an opening in said top, said actuating member having a flange on the lower end thereof, said flange extending radially outwardly from a central axis through said actuating member, said opening in said top being aligned with said point on said bottom, and said flange being of a greater diameter than the width of said opening;

a deformable resilient support member having a circular opening in the center thereof and having at least a portion thereof in contact with the lower surface of said flange;

spherical bearing means located in the opening in said support member, said bearing means engaging said point on the bottom of said housing and a point at the center of the bottom of said flange of said actuating member;

at least two conductive contact means located on the bottom of said deformable support member and positioned for bridging corresponding ones of said pairs of spaced-apart conductors, whereupon when said actuating member is tilted downwardly about said spherical bearing means toward a selected one of said pairs of spaced-apart conductors, a corresponding one of said contact means is pressed into contact to bridge the space between such selected one of said pairs of conductors to complete an electrical circuit therethrough so long as said actuating member remains tilted downwardly, release of said actuating member allowing said deforable resilient support member to return said actuating member to a rest position where none of said conductive contact means are in electrical contact with any of said spaced-apart pairs of conductors.

2. The combination according to claim 1 wherein said support member is made of rubber-like material.

3. The combination according to claim 2 wherein said conductive contact means are made of conductive rubber material.

4. The combination according to claim 3 wherein said conductive contact means are circular disks having a diameter greater than the space between the corresponding pairs of spaced-apart conductors.

5. The combination according to claim 3 wherein said spaced-apart conductors comprise printed circuit conductive strips extending in parallel pairs radially outwardly from said point on said bottom.

6. The combination according to claim 5 wherein said pairs of spaced-apart conductors comprise four pairs of spaced-apart conductors each located at ninety degree intervals in a circle, the center of which is said point on said bottom.

7. The combination according to claim 6 wherein said spherical bearing means comprises a ball bearing.

8. The combination according to claim 7 wherein said ball bearing is a metal ball bearing, and said bottom of said housing and said actuating member are made of plastic material.

9. The combination according to claim 7 wherein said actuating member has a body portion in the form of a cylindrical section and said flange on the lower end thereof is a circular flange having a diameter greater than the diameter of said body portion of said actuating member.

10. The combination according to claim 9 wherein the top of said actuating member is a concave surface.

11. The combination according to claim 10 wherein said deformable support member is a circular support member having an outer flange, with an inner portion spaced upwardly from the bottom edge of said outer flange, said conductive contact means being attached to said inner portion on the bottom side thereof and normally spaced above the corresponding pairs of said conductors, with said actuating member in a rest position thereof.

12. The combination according to claim 11 wherein at least a portion of said flange on said actuating member overlies said conductive contact means, with said rest position of said actuating member provided by a portion of the upper surface of said support member.

13. The combination according to claim 12 wherein a mating semi-spherical concave depression is formed on the bottom of said actuating member at the center thereof for engaging said spherical bearing means.

14. The combination according to claim 1 wherein said spherical bearing means comprises a ball bearing.

15. The combination according to claim 14 wherein said ball bearing is a metal ball bearing, and said bottom of said housing and said actuating member are made of plastic material.

16. The combination according to claim 1 wherein said actuating member has a body portion in the form of a cylindrical section and said flange on the lower end thereof is a circular flange having a diameter greater than the diameter of said body portion of said actuating member.

17. The combination according to claim 16 wherein the top of said actuating member is a concave surface.

18. The combination according to claim 16 wherein said deformable support member is a circular support member having an outer flange, with an inner portion spaced upwardly from the bottom edge of said outer flange, said conductive contact means being attached to said inner portion on the bottom side thereof and normally. spaced above the corresponding pairs of said conductors, with said actuating member in a rest position thereof.

19. The combination according to claim 1 wherein at least a portion of said flange on said actuating member overlies said conductive contact means, with said rest position of said actuating member provided by a portion of the upper surface of said support member.

20. The combination according to claim 1 wherein a mating semi-spherical concave depression is formed on the bottom of said actuating member at the center thereof for engaging said spherical bearing means.

21. The combination according to claim 1 wherein said pairs of spaced-apart conductors comprise four pairs of spaced-apart conductors each located at ninety degree intervals in a circle, the center of which is said point on said bottom.

22. The combination according to claim 1 wherein said spaced-apart conductors comprise printed circuit conductive strips extending in parallel pairs radially outwardly from said point on said bottom.

23. The combination according to claim 1 wherein said deformable support member is a circular support member having an outer flange, with an inner portion spaced upwardly from the bottom edge of said outer flange, said conductive contact means being attached to said inner portion on the bottom side thereof and normally spaced above the corresponding pairs of said conductors, with said actuating member in a rest position thereof.

24. The combination according to claim 1 wherein said conductive contact means are made of conductive rubber material.

25. The combination according to claim 24 wherein said conductive contact means are circular disks having a diameter greater than the space between the corresponding pairs of spaced-apart conductors.

* * * * *